US012655701B1

(12) United States Patent
Albalawi et al.

(10) Patent No.: US 12,655,701 B1
(45) Date of Patent: Jun. 16, 2026

(54) WELLHEAD PUSHER TOOL FOR A TUBING HANGER

(71) Applicant: SAUDI ARABIAN OIL COMPANY, Dhahran (SA)

(72) Inventors: Anas Mahmoud Albalawi, Dhahran (SA); Noor Chozin Ali Che Jaffar, Dhahran (SA); Mohanad Asali, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 19/040,083

(22) Filed: Jan. 29, 2025

(51) Int. Cl.
*E21B 23/04* (2006.01)
*E21B 33/04* (2006.01)

(52) U.S. Cl.
CPC ..... *E21B 23/042* (2020.05); *E21B 33/04* (2013.01)

(58) Field of Classification Search
CPC ..... E21B 33/04; E21B 33/0415; E21B 23/042
See application file for complete search history.

(56) References Cited

U.S. PATENT DOCUMENTS 8,590,624 B2 * 11/2013 Neto ..... E21B 23/01 166/85.1
2007/0246220 A1 10/2007 Fenton
2014/0166298 A1 * 6/2014 Fenwick ..... E21B 23/00 166/360

FOREIGN PATENT DOCUMENTS

| | | | |
|---|---|---|---|
| CN | 110017109 | A | 7/2019 |
| CN | 213775303 | U | 7/2021 |
| CN | 114370246 | A | 4/2022 |
| CN | 114622858 | A | 6/2022 |
| CN | 220267638 | U | 12/2023 |

* cited by examiner

*Primary Examiner* — Giovanna Wright
(74) *Attorney, Agent, or Firm* — Osha Bergman Watanabe & Burton LLP

(57) ABSTRACT

A wellhead pusher tool and method for replacing a tubing hanger. The tool includes an upper body coupled to the tubing hanger including an internal section, a lower body fitted inside the internal section, a piston assembly, and a control line hydraulically connected to the chamber. The lower body moves inside the upper body via a sliding face in the internal section. The piston assembly includes a piston which moves inside a chamber and a spring mechanism. The control line injects and removes fluid from the chamber to move the piston to compress and expand the spring mechanism. The lower body slides towards the tubing as the piston compresses the spring mechanism thereby pushing the tubing hanger out of a tubing spool as the upper body is pushed towards the tubing hanger. The tubing hanger is removed once the tubing hanger is pushed out of the tubing spool.

20 Claims, 6 Drawing Sheets

WELLHEAD PUSHER TOOL FOR A TUBING HANGER

BACKGROUND

In the petroleum industry, it is common in mechanical workover jobs attended by workover rigs to include repairing a well tubing-casing annulus (TCA) with communication. Repairing the well TCA may be due to observed pressure communication between shut-in wellhead pressure and the TCA. A number of these cases observed that the tubing hanger connection between the top tubing joint had a leak. Conventionally, a leaking tubing hanger or a compromised tubing hanger requires de-completion of the entire existing completion tubing string to be pulled out in order to change the tubing hanger, requiring expensive workover rigs.

Accordingly, there exists a need for a tool that allows a user to change a leaking tubing hanger with a new one without the need to de-complete the entire tubing string. This tool eliminates rig time and services for removing existing completion strings. Another advantage includes eliminating tangible costs for replacing the entire completion string.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a wellhead pusher tool for replacing a tubing hanger comprising: an upper body coupled to the tubing hanger comprising an internal section having a sliding face; a lower body fitted inside the internal section of the upper body having an outer section, the lower body configured to move inside the upper body via the sliding face; a piston assembly disposed in the outer section, the piston assembly comprising: a piston coupled to the upper body disposed in a chamber configured to move inside the chamber; and a spring mechanism having a first leg attached to a first end of the chamber and a second leg attached to the piston, the spring mechanism configured to compress and expand in relation to movement of the piston; and a control line hydraulically connected to a second end of the chamber through a port in the upper body configured to inject and remove fluid from the chamber, wherein the injection and removal of fluid from the chamber controls movement of the piston thereby compressing and expanding the spring mechanism, wherein the lower body is slid towards the tubing and partially out of the internal section as the piston is pushed towards the first end of the chamber thereby pushing the tubing hanger out of a tubing spool profile once the upper body is pushed towards the tubing hanger and the lower body is slid towards the tubing, and wherein the tubing hanger is removed from the upper body once the tubing hanger is pushed out of the tubing spool profile.

In one aspect, embodiments disclosed herein relate to a method for a wellhead pusher tool for replacing a tubing hanger, comprising: installing an upper body of the wellhead pusher tool to the tubing hanger; fitting a lower body of the wellhead pusher tool inside an internal section of the upper body; coupling the lower body comprising a piston assembly having a chamber in an outer section of the lower body to a tubing, wherein the lower body comprises a piston coupled to the upper body disposed in the chamber and a spring mechanism having a first leg attached to a first end of the chamber and a second leg attached to the piston; injecting a fluid into a second end of the chamber, via a control line, through a port in the upper body; pushing the piston towards the first end of the chamber after fluid injection to compress the spring mechanism to push the upper body towards the tubing hanger; sliding the lower body towards the tubing and partially out of the internal section, via a sliding face in the internal section of the upper body, as the piston is pushed towards the first end of the chamber; pushing the tubing hanger out of a tubing spool profile once the upper body is pushed towards the tubing hanger and the lower body is slid towards the tubing; and removing the tubing hanger from the upper body once the tubing hanger is pushed out of the tubing spool profile.

Other aspects and advantages of the claimed subject matter will be apparent from the following description and the appended claims.

DETAILED DESCRIPTION

Figure 1:
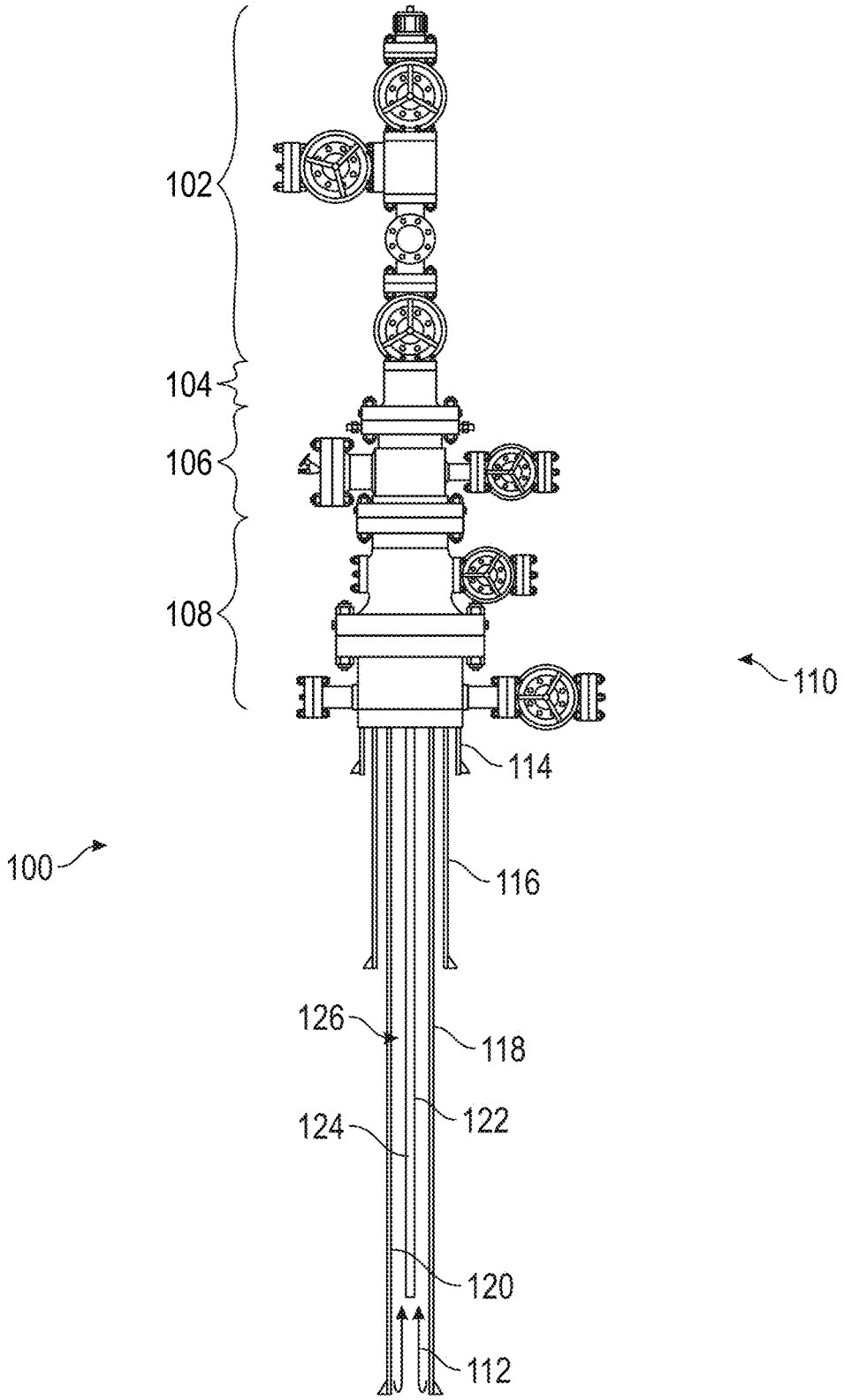
FIG. 1 shows an exemplary well in accordance with one or more embodiments.

Specific embodiments of the disclosure will now be described in detail with reference to the accompanying figures. Like elements in the various figures are denoted by like reference numerals for consistency.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Regarding the figures described herein, when using the term "down" the direction is toward or at the bottom of a respective figure and "up" is toward or at the top of the respective figure. "Up" and "down" are oriented relative to a local vertical direction. However, in the oil and gas industry, one or more activities take place in a vertical, substantially vertical, deviated, substantially horizontal, or horizontal well. Therefore, one or more figures may represent an activity in deviated or horizontal wellbore configuration. "Uphole" may refer to objects, units, or processes that are positioned relatively closer to the surface entry in a wellbore than another. "Downhole" may refer to objects, units, or processes that are positioned relatively farther from the surface entry in a wellbore than another. True vertical depth is the vertical distance from a point in the well at a location of interest to a reference point on the surface.

FIG. 1 shows an exemplary well (100) in accordance with one or more embodiments. The well (100) includes a tree (102), a tubing bonnet (104), a tubing spool (106), and a casing head (108) located on a surface location (110) that may be located anywhere on the Earth's surface. The tree (102) has a plurality of valves that control the production of production fluids (112) that come from a production zone located beneath the surface location (110). The valves also allow for access to the subsurface portion of the well (100).

The well (100) has three strings of casing: conductor casing (114), surface casing (116), and production casing (118). The casing strings are made of a plurality of long high-diameter tubulars threaded together. The tubulars may be made out of any durable material known in the art, such as steel. The casing strings are cemented in place within the well (100). The casing strings may be fully or partially cemented in place without departing from the scope of the disclosure herein.

Each string of casing, starting with the conductor casing (114) and ending with the production casing (118), decreases in both outer diameter and inner diameter such that the surface casing (116) is nested within the conductor casing (114) and the production casing (118) is nested within the surface casing (116). Upon completion of the well (100), the inner circumferential surface (120) of the production casing (118) and the space located within the production casing (118), make up the interior of the well (100).

The majority of the length of the conductor casing (114), surface casing (116), and production casing (118) are located underground. However, the surface-extending portion of each casing string is housed in the casing head (108), also known as a wellhead, located at the surface location (110). The surface-extending portion of each casing string may include a casing hanger (not pictured) that is specially machined to be set and hung within the casing head (108). There may be multiple casing heads (108) depending on the number of casing strings without departing from the scope of the disclosure herein.

Production tubing (122) is deployed within the production casing (118). The production tubing (122) may include a plurality of tubulars connected together, such as tubing joints, and may be interspersed with various pieces of equipment such as artificial lift equipment, packers, etc. The space formed between the outer circumferential surface (124) of the production tubing (122) and the inner circumferential surface (120) of the production casing (118) is called the tubing-casing annulus (126).

The majority of the length of the production tubing (122) is located in the interior of the well (100) underground. However, the surface-extending portion of the production tubing (122) is housed in the tubing spool (106) or tubing head which is installed on top of the casing head (108). The surface-extending portion of the production tubing (122) may include a tubing hanger (shown in FIG. 2) that is specially machined to be set and hung within the tubing spool (106). The tubing hanger (shown in FIG. 2) may suspend a top tubing joint of the production tubing (122). The tree (102) is connected to the top of the tubing spool (106) using the tubing bonnet (104). The tubing bonnet (104) is an adapter comprising one or more seals (not pictured).

In accordance with one or more embodiments, the production casing (118) may comprise a portion made of slotted casing or screen such that production fluids may flow into the production casing (118) from the formation. In other embodiments, the production casing (118) may include perforations made through the production casing (118), cement, and wellbore in order to provide a pathway for the production fluids (112) to flow from the production zone into the interior of the well (100).

The production fluids (112) may travel from the interior of the well (100) to the surface location (110) through the production tubing (122). A pipeline (not pictured) may be connected to the tree (102) to transport the production fluids (112) away from the well (100). The well (100) depicted in FIG. 1 is one example of a well (100) but is not meant to be limiting. The scope of this disclosure encompasses any well (100) design that has at least one string of casing in the well (100). Further, the well (100) may have other variations of surface equipment without departing from the scope of this disclosure.

In conventional well (100) designs, once the production tubing (122) is installed and the tubing hanger has been landed in the tubing spool (106), there is no way to repair or replace the tubing hanger without removing the entire production tubing (122) from the well (100). Over the life of the well, there may be multiple scenarios in which the tubing hanger must be replaced in order to repair a leak commonly found between the tubing hanger and the top tubing joint.

Removing the production tubing (122) from the well (100) is a time consuming and unsafe operation in terms of well control. Therefore, the ability to replace or repair a leaking or compromised tubing hanger without having to de-complete the well (100) and remove the production tubing (122) is beneficial. As such, embodiments presented herein disclose systems and methods for replacing a tubing hanger without removing the production tubing (122) from the well (100) using a wellhead pusher tool (300).

Figure 2:
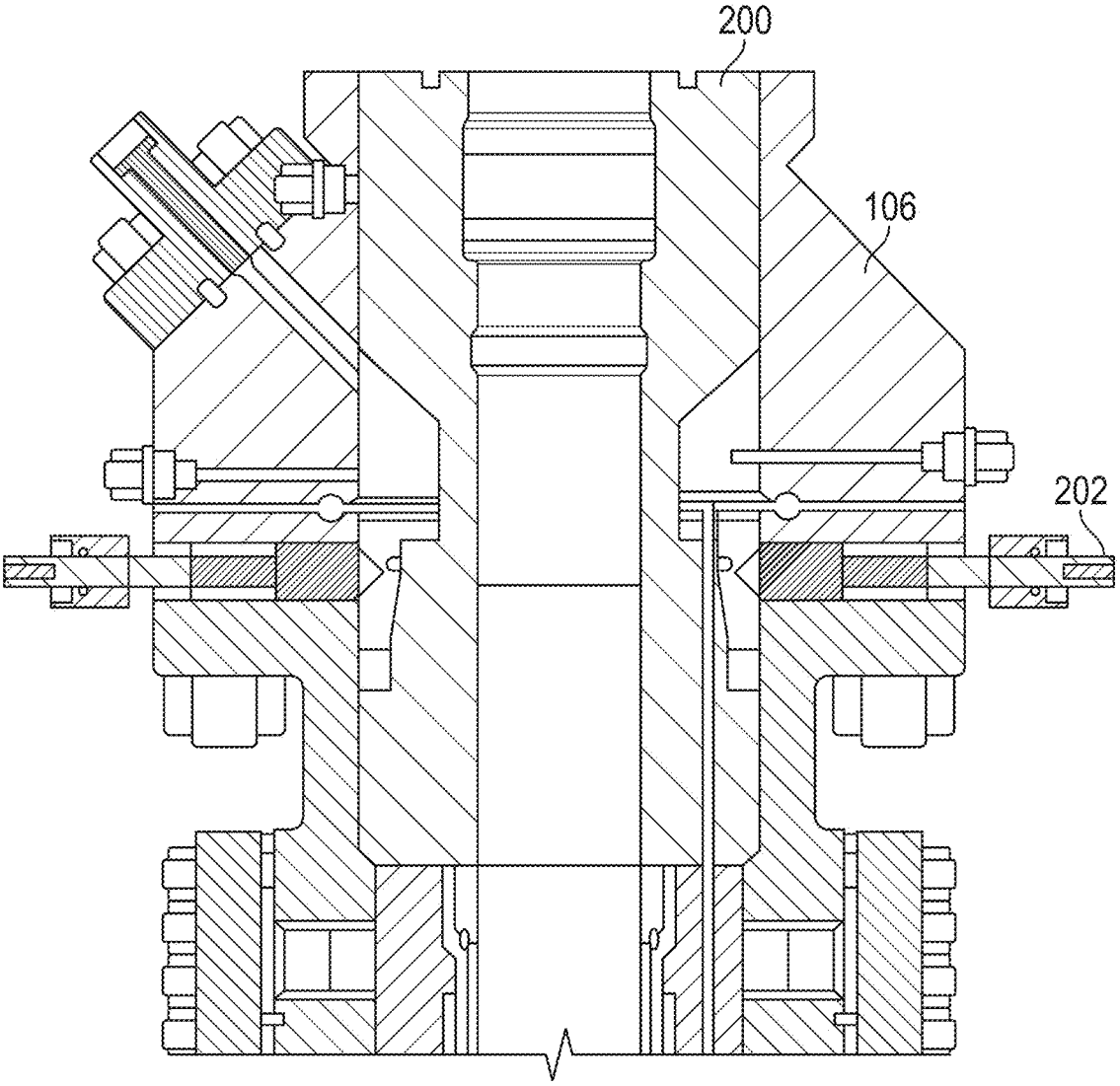
FIG. 2 shows an internal view of a tubing spool including a tubing hanger in accordance with one or more embodiments.

FIG. 2 shows an internal view of a tubing spool including a tubing hanger in accordance with one or more embodiments. Specifically, FIG. 2 illustrates a tubing hanger (200) supported inside the tubing spool (106) as described in FIG. 1. The tubing hanger (200) supports the weight of the entire production tubing (122) and/or casing (118). The tubing hanger (200) is used to provide a seal for the tubing-casing annulus (126) described in FIG. 1. The tubing hanger (200) is sealed inside the tubing spool (106) or head to ensure the tubing-casing annulus (126) is hydraulically isolated. In some embodiments, the tubing spool (106) includes flanges (205), shown in FIGS. 3-5. In one or more embodiments, the tubing hanger (200) may provide porting to allow communication of hydraulic, electric, and other downhole functions, such as chemical injection. A person of ordinary skill in the art may appreciate that the tubing hanger (200) may be secured and locked in place into the tubing spool (106) using locking pins or screws (202).

Figure 3:
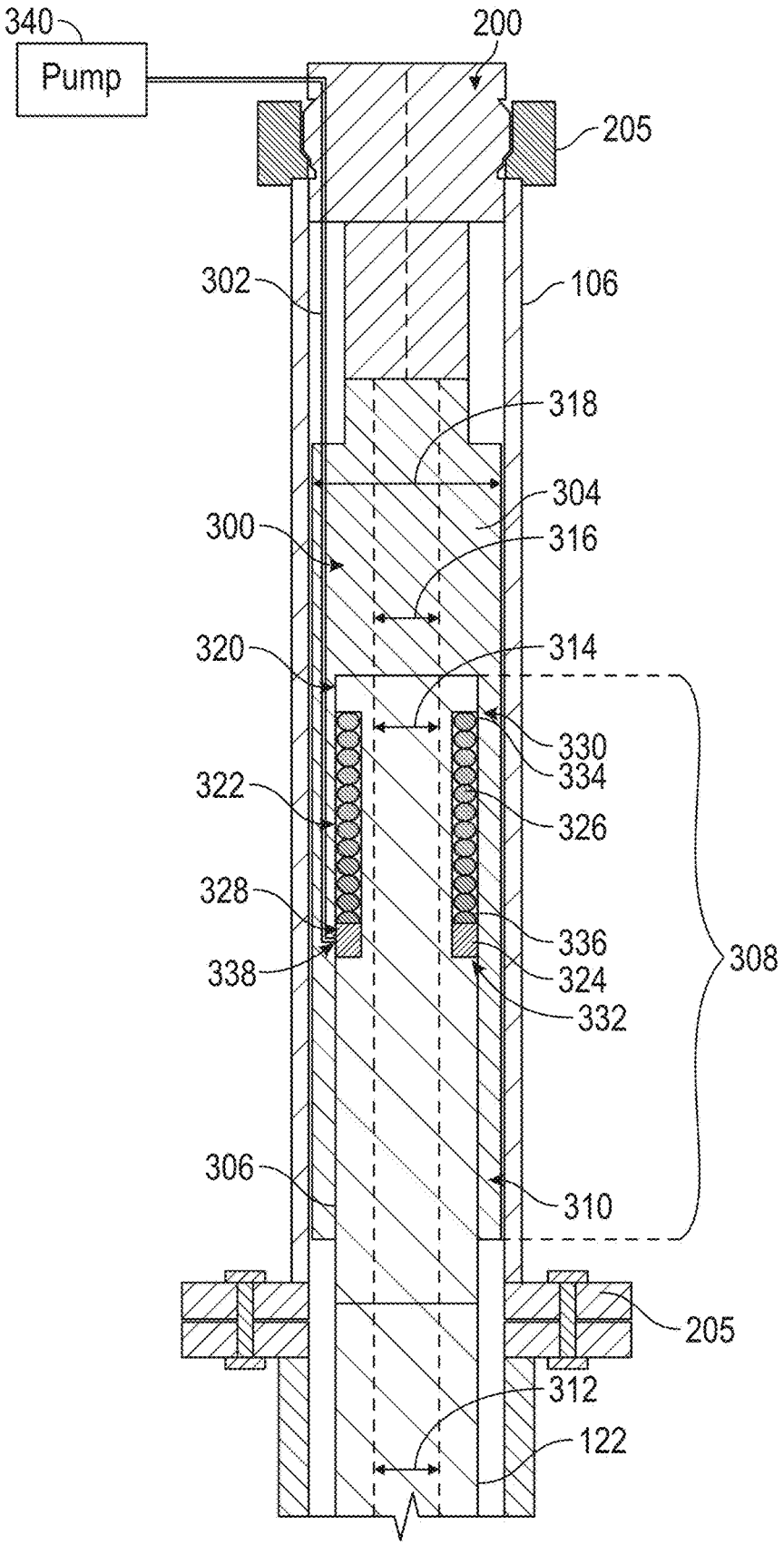
FIG. 3 shows a system in accordance with one or more embodiments.

FIG. 3 shows a system in accordance with one or more embodiments. FIG. 3 shows a wellhead pusher tool (300) which may be used in the system described in FIGS. 1 and 2. For example, the wellhead pusher tool (300) is installed during completion tubing installation in a well and is used to replace the tubing hanger (200) of the well. The wellhead pusher tool (300) may be placed immediately below the tubing hanger (200). As further described in detail herein, the wellhead pusher tool (300) is a moveable tool that helps push the tubing hanger (200) out of the tubing spool (106) in order to replace the tubing hanger (200) for rig-less intervention without de-completing the well (100). The tubing hanger (200) may have a leak or be compromised. FIG. 3 specifically illustrates an initial position after installation of the system. In the initial position, a control line (302) is connected to the wellhead pusher tool (300) and tested. After testing, all pressures may be bled off from the control line (302) to ensure the wellhead pusher tool (300) is fully retracted. As described herein, the wellhead pusher tool (300) may utilize telescopic mechanisms using a piston effect from high pressure hydraulic fluid from below and a spring mechanism from above to move a connected tubing joint and tubing hanger up and down.

The wellhead pusher tool (300) includes an upper body (304) and a lower body (306). The upper body (304) and the lower body (306) may have a cylindrical shape. The upper body (304) is coupled to the tubing hanger (200) and includes an internal section (308) and a sliding face (310). The lower body (306) is fitted inside the internal section (308) of the upper body (304). The lower body (306) moves inside the upper body (304) via the sliding face (310) in the upper body (304). The internal section (308) may be an area inside the upper body (304) capable of fitting a small portion, a large portion, or all of the lower body (306) inside. FIG. 3 illustrates the space of the internal section (308) currently occupied by the lower body (306) in the initial position. The lower body (306) is coupled to production tubing (122). The production tubing (122) is hydraulically connected to the tubing hanger (200) through the wellhead pusher tool (300) as shown by the dashed line indicating a production tubing inner diameter (312), a lower body inner diameter (314), and a upper body inner diameter (316). The upper body inner diameter (316) may be equivalent to the production tubing inner diameter (312). An upper body outer diameter (318) may be smaller than an inner diameter of the casing (118) or an inner diameter of a wellhead or casing head (108), both shown in FIG. 1. A person of ordinary skill in the art may appreciate that the wellhead pusher tool (300) may include top and bottom connections of the same size and type compatible with industry completion tubing connections.

An outer section (320) of the lower body (306) houses a piston assembly (322). The piston assembly (322) includes a piston (324) and a spring mechanism (326). The piston (324) is coupled to the upper body (304) so as to move with the upper body (304). The piston (324) is designed to move inside a chamber in the outer section (320) of the lower body (306). The chamber (328) is a hydraulic fluid chamber. FIG. 3 shows an upper end (330) and a lower end (332) of the chamber (328). Either the upper end (330) or the lower end (332) may be considered a "first" end and the other may be considered a "second" end. The spring mechanism (326) includes a first leg (334) and a second leg (336). The first leg (334) is attached to an upper end (330) of the chamber (328). The second leg (336) is attached to the piston (324). The spring mechanism (326) compresses and expands in relation to the movement of the piston (324). For example, if the piston (324) moves towards the upper end (330) of the chamber (328), then the spring mechanism (326) compresses. If the piston (324) moves towards the lower end (332) of the chamber (328), the spring mechanism (326) expands or releases.

The control line (302) is hydraulically connected to the lower end (332) of the chamber (328) through a port (338) in the upper body (304). The control line (302) may be any hydraulically capable pipe or line used for injection. The control line (302) injects and removes fluid (shown in FIG. 4) from the chamber (328). The control line (302) may be coupled to the tubing hanger (200) or equipment on surface location (110). The chamber (328) may be isolated from fluids in or out of the production tubing (122), such as in the tubing-casing annulus (126). In the initial position fully retracted, as illustrated in FIG. 3, the chamber (328) below the piston (324) is empty and the spring mechanism (326) above the piston (324) is not compressed or loaded. In some embodiments, a pump (340) is connected to the control line (302) and tubing spool (106).

Figure 4:
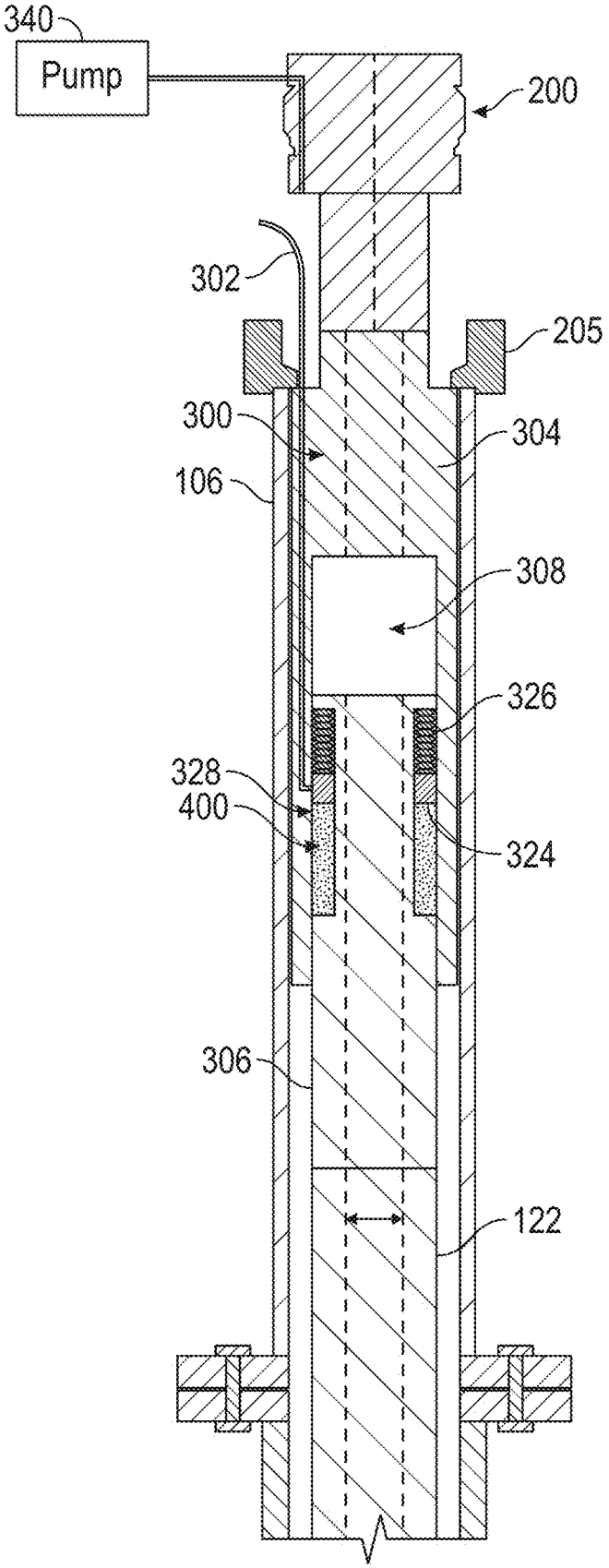
FIG. 4 shows the system of FIG. 3 activated in an extended position in accordance with one or more embodiments.

FIG. 4 shows the system of FIG. 3 activated in an extended position in accordance with one or more embodiments. Specifically, FIG. 4 shows the wellhead pusher tool (300) during a rig-less job to change or replace the tubing hanger (200). In some embodiments, after the well (100) is secured and lockdown screws (202) on the tubing hanger (200) are retracted, the test pump (340) is connected to the control line (302) and pressure is applied by injecting fluid (400) into the control line (302) and the chamber (328). FIG. 4 shows the wellhead pusher tool (300) after injection of fluid (400) from the control line (302) into the chamber (328). As illustrated, the piston (324) is pushed towards the upper end (330) of the chamber (328) due to the pressure of the injected fluid (400) in the chamber (328). The fluid (400) may be pressurized using the pump (340) connected to the control line (302). The piston (324) is pushed towards the upper end (330) compressing and loading the spring mechanism (326). In one or more embodiments, the pressure inside the control line (302) is kept and isolated at surface location (110).

As the piston (324) moves towards the first end of the chamber (328), the lower body (306) is slid towards production tubing (122) and partially out of the internal section (308) of the upper body (304). The piston (324) movement pushes the upper body (304) towards the tubing hanger (200) thereby pushing the tubing hanger (200) out of the tubing spool (106). The tubing hanger (200) may be pushed upward about 10 feet. In some embodiments, pup joint connections located below the tubing hanger (200) may then be exposed. For example, a pump joint may be connected to an upper connection of the wellhead pusher tool (300), such as the upper body (304). The control line (302) may then be disconnected from the tubing hanger (200) while pressure is isolated. The tubing hanger (200) may then be removed from the upper body (304), as shown in FIG. 4.

Figure 5:
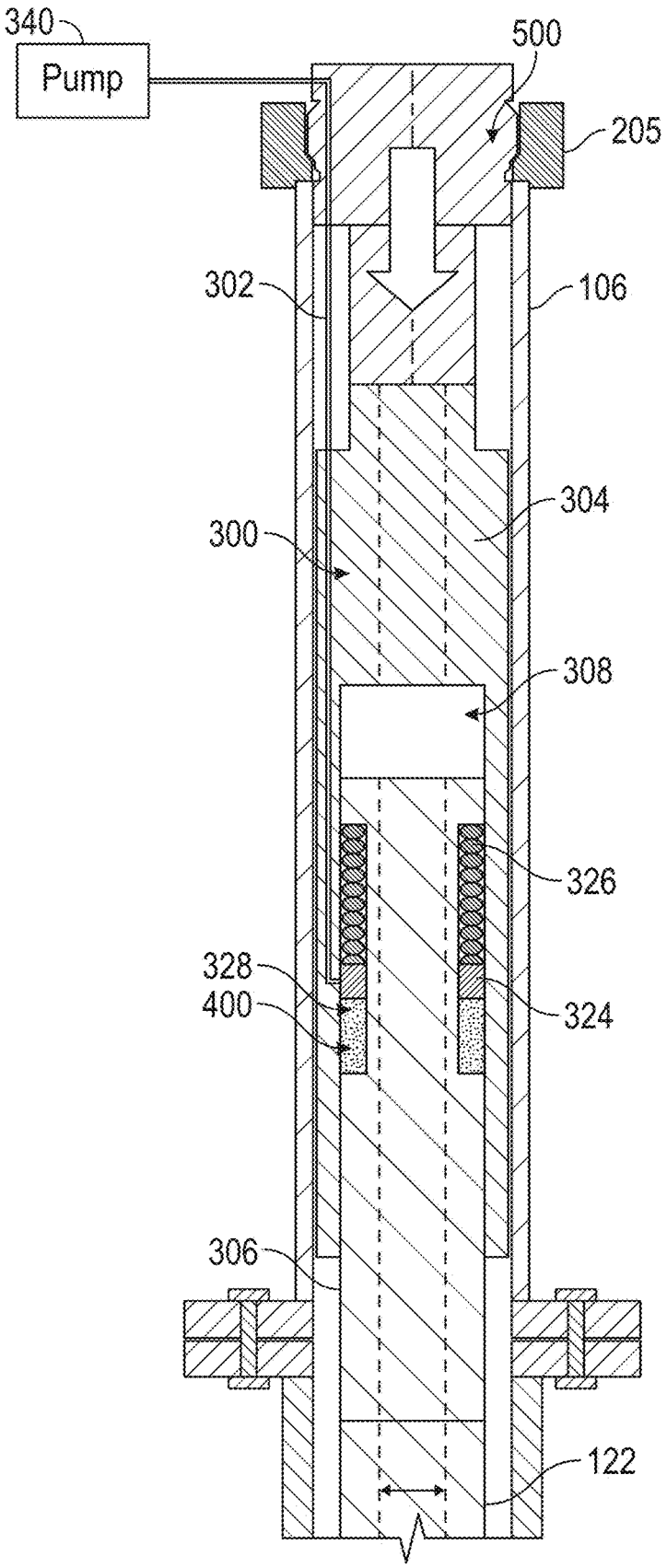
FIG. 5 shows the system of FIG. 4 after replacement of the tubing hanger and returning to original position in accordance with one or more embodiments.

FIG. 5 shows the system of FIG. 4 after replacement of the tubing hanger and returning to original position in accordance with one or more embodiments. A new tubing hanger (500) may then replace the old tubing hanger (200) by installing the new tubing hanger (500) to the upper body (304) or upper connection as described previously. The control line (302) is then reconnected to the new tubing hanger (500). Specifically, FIG. 5 shows the wellhead pusher tool (300) being bled-off and removed of fluid (400) from the chamber (328) through the control line (302) after replacing the tubing hanger (200). By removing pressure below the piston (324) after removing the fluid (400) from the chamber (328), the previously compressed or loaded spring mechanism (326) uncoils and expands to push the piston (324) down towards the lower end of the chamber (328).

As illustrated in FIG. 5, the piston (324) moves towards the lower end (332) as the fluid (400) in the chamber (328) is removed causing the spring mechanism (326) to expand and decompress with the piston (324). The internal section (308) of the upper body (304) becomes smaller as the lower body (306) slides back into the internal section (308) as the piston (324) pushes the upper body (304) towards the production tubing (122). The new tubing hanger (500) may move into place into its profile inside the tubing spool (106). Lockdown screws (202) may be utilized to lock or secure the tubing hanger (500) in place. Other wellhead equipment may then be re-installed.

Figure 6:
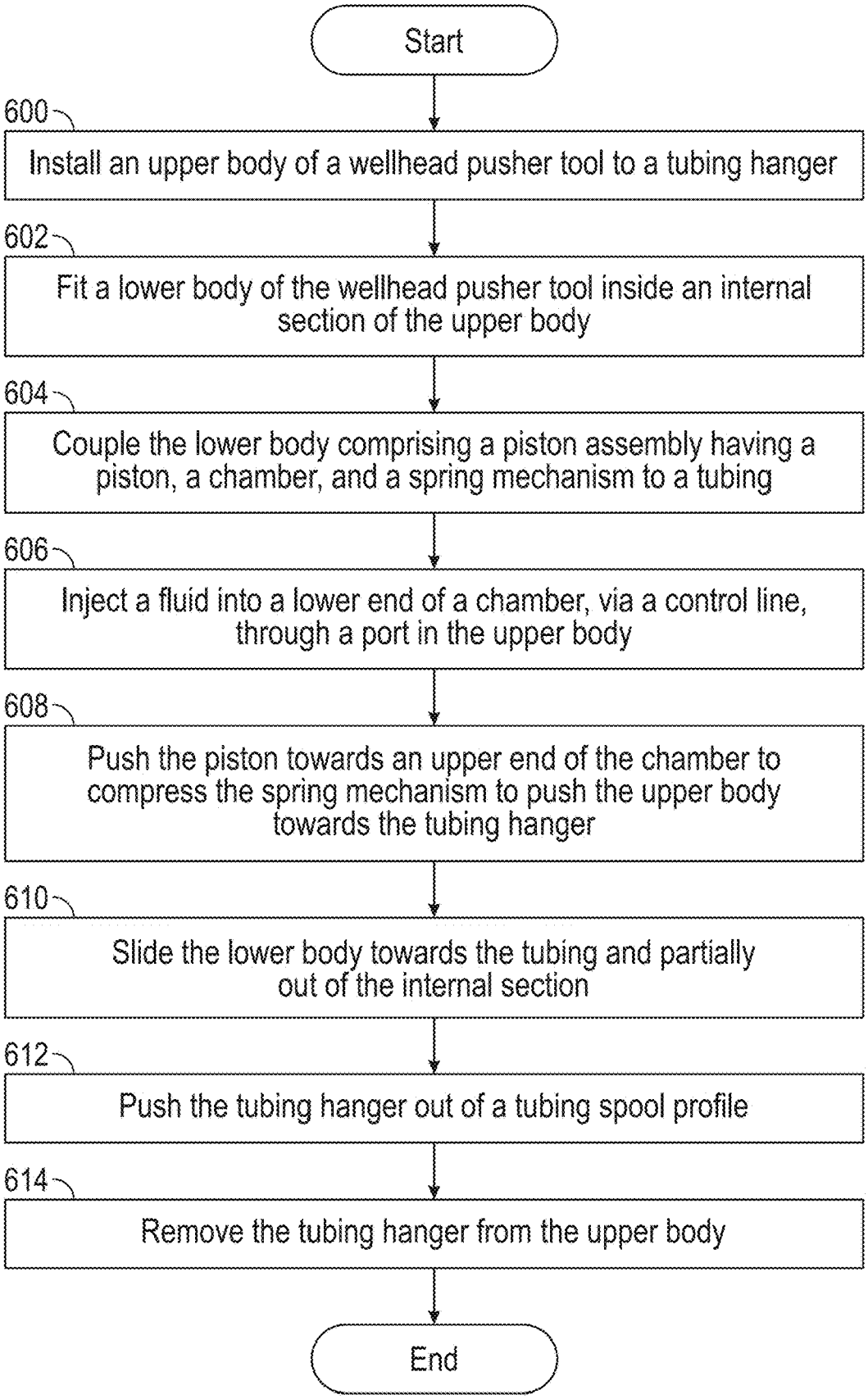
FIG. 6 shows a flowchart in accordance with one or more embodiments.

FIG. 6 shows a flowchart in accordance with one or more embodiments.

Specifically, FIG. 6 shows the methodology for a wellhead pusher tool for replacing a tubing hanger. One or more blocks in FIG. 6 may be performed by one or more components (e.g., the wellhead pusher tool (300)) as described in FIGS. 1-5. While various blocks in FIG. 6 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 600, an upper body of the wellhead pusher tool is installed to a tubing hanger. In Block 602, a lower body of the wellhead pusher tool is fitted inside an internal section of the upper body. The upper body and the lower body may be of cylindrical shape. In Block 604, the lower body comprising a piston assembly having a piston, a chamber, and a spring mechanism is coupled to a tubing. The tubing may be production tubing. The chamber is located in an outer section of the lower body. The piston is coupled to the upper body disposed in the chamber. The spring mechanism includes a first leg attached to an upper end of the chamber and a second leg attached to the piston.

In Block 606, a fluid is injected into the lower end of the chamber, via a control line, through a port in the upper body. The control line may be coupled to surface equipment or a tubing hanger. In Block 608, the piston is pushed towards the upper end of the chamber to compress the spring mechanism and push the upper body towards the tubing hanger. In Block 610, the lower body slides toward the tubing and partially out of the internal section. A sliding face in the internal section of the upper body allows the lower body to slide or move inside the internal section. In Block 612, the tubing hanger is pushed out of the tubing spool profile. In one or more embodiments, the tubing hanger is placed into the tubing spool profile for locking the tubing hanger in place. The tubing hanger may be locked by screwing screws into the tubing spool profile. Wellhead equipment may be installed once the tubing hanger is screwed in the tubing spool profile. In Block 614, the tubing hanger is removed from the upper body.

In some embodiments, the tubing hanger is replaced with a new tubing hanger after removing the tubing hanger. The fluid from the chamber may be removed using the control like. The piston may be released towards the second end of the chamber after removal of the fluid to expand the spring mechanism and push the upper body towards the tubing. The lower body may then slide using the sliding face into the internal section of the upper body towards the tubing hanger as the piston is released.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A wellhead pusher tool for replacing a tubing hanger comprising:

an upper body coupled to the tubing hanger comprising an internal section having a sliding face;

a lower body fitted inside the internal section of the upper body having an outer section, the lower body configured to move inside the upper body via the sliding face;

a piston assembly disposed in the outer section, the piston assembly comprising:

a piston coupled to the upper body disposed in a chamber configured to move inside the chamber; and a spring mechanism having a first leg attached to a first end of the chamber and a second leg attached to the piston, the spring mechanism configured to compress and expand in relation to movement of the piston; and a control line hydraulically connected to a second end of the chamber through a port in the upper body configured to inject and remove fluid from the chamber, wherein the injection and removal of fluid from the chamber controls movement of the piston thereby compressing and expanding the spring mechanism, wherein the lower body is slid towards a tubing and partially out of the internal section as the piston is pushed towards the first end of the chamber thereby pushing the tubing hanger out of a tubing spool profile once the upper body is pushed towards the tubing hanger and the lower body is slid towards the tubing, and wherein the tubing hanger is removed from the upper body once the tubing hanger is pushed out of the tubing spool profile.

2. The wellhead pusher tool of claim 1, wherein the lower body is connected to the tubing.

3. The wellhead pusher tool of claim 2, wherein the chamber is isolated from fluids in or out of the tubing.

4. The wellhead pusher tool of claim 2, wherein the upper body comprises an inner diameter equivalent to an inner diameter of the tubing.

5. The wellhead pusher tool of claim 1, wherein the upper body and the lower body comprise a cylindrical shape.

6. The wellhead pusher tool of claim 1, wherein the control line is coupled to a surface equipment.

7. The wellhead pusher tool of claim 1, wherein the upper body comprises an outer diameter smaller than a casing inner diameter or a wellhead inner diameter.

8. The wellhead pusher tool of claim 1, wherein the tubing hanger comprises a leak.

9. The wellhead pusher tool of claim 1, wherein the fluid is pressurized using a pump connected to the control line.

10. The wellhead pusher tool of claim 1, wherein the tubing hanger is disposed inside the tubing spool profile.

11. A method for a wellhead pusher tool for replacing a tubing hanger, comprising:

installing an upper body of the wellhead pusher tool to the tubing hanger;

fitting a lower body of the wellhead pusher tool inside an internal section of the upper body;

coupling the lower body comprising a piston assembly having a chamber in an outer section of the lower body to a tubing, wherein the piston assembly comprises a piston coupled to the upper body disposed in the chamber and a spring mechanism having a first leg attached to a first end of the chamber and a second leg attached to the piston;

injecting a fluid into a second end of the chamber, via a control line, through a port in the upper body;

pushing the piston towards the first end of the chamber after fluid injection to compress the spring mechanism to push the upper body towards the tubing hanger;

sliding the lower body towards the tubing and partially out of the internal section, via a sliding face in the internal section of the upper body, as the piston is pushed towards the first end of the chamber;

pushing the tubing hanger out of a tubing spool profile once the upper body is pushed towards the tubing hanger and the lower body is slid towards the tubing; and removing the tubing hanger from the upper body once the tubing hanger is pushed out of the tubing spool profile.

12. The method of claim 11, further comprising:

replacing the tubing hanger with a new tubing hanger after removing the tubing hanger;

removing the fluid from the chamber, via the control line;

releasing the piston towards the second end of the chamber after removal of the fluid to expand the spring mechanism to push the upper body towards the tubing; and sliding the lower body, via the sliding face, into the internal section of the upper body towards the new tubing hanger as the piston is released.

13. The method of claim 12, further comprising:

placing the new tubing hanger into the tubing spool profile for locking the new tubing hanger.

14. The method of claim 13, wherein locking the new tubing hanger comprises screwing a plurality of screws into the tubing spool profile.

15. The method of claim 14, further comprising:

installing a wellhead equipment once the new tubing hanger is screwed in the tubing spool profile.

16. The method of claim 12, wherein removing the fluid comprises bleeding off pressure from the control line.

17. The method of claim 11, wherein the upper body and the lower body comprise a cylindrical shape.

18. The method of claim 11, wherein injecting the fluid comprises coupling the control line to a surface equipment.

19. The method of claim 11, wherein injecting the fluid comprises pressurizing the fluid using a pump connected to the control line.

20. The method of claim 11, wherein the chamber is isolated from tubing fluid or casing fluid.

* * * * *